US005176556A

United States Patent [19]

Morohashi

[11] Patent Number: 5,176,556

[45] Date of Patent: Jan. 5, 1993

[54] METHOD OF MANUFACTURING COLOR CATHODE RAY TUBE APPARATUS

[75] Inventor: Katsuei Morohashi, Saitama, Japan

[73] Assignee: Kabushiki Kaisha Toshiba, Kawasaki, Japan

[21] Appl. No.: 664,585

[22] Filed: Mar. 6, 1991

[30] Foreign Application Priority Data

Mar. 8, 1990 [JP] Japan ..... 2-57682

[51] Int. Cl.[5] ..... H01J 9/42; H01J 9/44

[52] U.S. Cl. ..... 445/3; 445/6

[58] Field of Search ..... 445/3, 4, 6

[56] References Cited

U.S. PATENT DOCUMENTS

| | | | |
|---|---|---|---|
| 4,211,960 | 7/1980 | Barten et al. | 315/368 |
| 4,578,661 | 3/1986 | van Rijsewijk et al. | 335/212 |
| 4,608,516 | 8/1986 | Oki | 313/318 |
| 4,662,853 | 5/1987 | Van Veldhoven | 445/3 |
| 5,017,832 | 5/1991 | Takita | 313/437 |

FOREIGN PATENT DOCUMENTS

| | | | |
|---|---|---|---|
| 0123611 | 10/1984 | European Pat. Off. | 445/3 |
| 0123612 | 10/1984 | European Pat. Off. | 445/3 |
| 52-117517 | 10/1977 | Japan . | |
| 54-18235 | 2/1979 | Japan . | |
| 63-7420 | 2/1988 | Japan . | |

*Primary Examiner*—Richard K. Seidel
*Assistant Examiner*—Jeffrey T. Knapp
*Attorney, Agent, or Firm*—Cushman, Darby & Cushman

[57] ABSTRACT

Magnetization of a magnetic member used for correcting the static convergence and color purity of a color cathode ray tube apparatus must be performed in consideration of the influences of geomagnetism. A magnetization unit used for magnetizing the magnetic member changes the state of geomagnetism around the neck of the apparatus. However, the magnetization unit can establish the same state of geomagnetism as that obtained when the magnetization unit is not arranged. This allows accurate correction of the static convergence and the color purity.

17 Claims, 4 Drawing Sheets

METHOD OF MANUFACTURING COLOR CATHODE RAY TUBE APPARATUS

BACKGROUND OF THE INVENTION

1. Field of the Invention

The present invention relates to a method of manufacturing a color cathode ray tube apparatus and, more particularly, to a method of manufacturing a color cathode ray tube apparatus having a magnetic member arranged at least either inside or outside a neck in which electron guns are housed.

2. Description of the Related Art

A conventional color cathode ray tube apparatus includes a tube having a panel 2, a funnel 4 continuous with the panel 2, and a cylindrical neck 6 connected to the funnel 4, as shown in FIG. 1. A shadow mask 12 is arranged inside the panel 2, and a phosphor screen 5 consisting of light-emitting layers for emitting three colors, i.e., red, green, and blue, is formed on the inner surface of the panel to oppose the shadow mask 12. Electron guns 7 for emitting three electron beams $B_R$, $B_G$, and $B_B$ are housed in the neck 6. A deflection unit 14 is arranged outside a boundary portion between the funnel 4 and the neck 6 to horizontally and vertically deflect the three electron beams $B_R$, $B_G$, and $B_B$ emitted from the electron guns 7. In addition, a magnet 9 for adjusting static convergence and color purity is arranged outside the neck 6.

The above-mentioned magnet 9 is constituted by three pairs of annular permanent magnets respectively having two, four, and six magnetic poles. The annular permanent magnets are rotated about the tube axis (Z axis) to change the positions of magnetic poles. With this operation, static convergence and color purity are adjusted.

The above-mentioned adjustment of static convergence and color purity is manually performed. Since this adjustment is complicated, even a skilled operator requires much time to perform it.

FIG. 2 shows another conventional apparatus designed to solve the problem of adjustment of static convergence and color purity which is performed by the magnet 9. In this apparatus, one or more magnetizable annular magnetic members 11 are arranged around electron guns 7 housed in a neck 6 in place of the magnet 9. In this case, the magnetic member 11 is polarized and magnetized to obtain two, four, six, and twelve magnetic poles during test and adjustment operations in the final assembly process of a color cathode ray tube apparatus. With this arrangement, the same effect as obtained by the magnet 9 can be obtained.

Methods similar to the above-described polarization/magnetization method are disclosed in Published Unexamined Japanese Patent Application Nos. 52-117517 and 54-18235 and Published Examined Japanese Patent Application No. 63-7420. These three conventional methods will be described below.

First, in the method disclosed in Published Unexamined Japanese Patent Application No. 52-117517, static convergence and color purity are adjusted in advance by an adjusting unit. Magnetizing currents are supplied from this adjusting unit on the basis of adjustment information, and DC magnetic fields are generated by using magnetizing coils, thus magnetizing a magnetic member.

In this method, when the magnetic member is to be magnetized to have a plurality of magnetic poles, its magnetization state cannot be accurately controlled for the following reasons. For example, a combination of two, four, and six magnetic poles are to be obtained, the state of each magnetic pole obtained by magnetization is easily changed. In addition, owing to the magnetization characteristics of the magnetic member, a linear relationship is not established between the magnetizing force of a desired magnetic pole and a magnetic field at an accurate position of magnetization. In this method, therefore, it is very difficult to magnetize the magnetic member to obtain a combination of two, four, and six magnetic poles. Furthermore, when magnetization is performed to obtain the respective poles, the magnetic characteristics of portions, of the magnetic member, other than the magnetic poles are changed. For this reason, two, four, and six magnetic poles cannot be sequentially obtained. With regard to a magnetic member in the neck, since the distance between the magnetic member and magnetizing magnetic poles is large, a magnetic flux diverges, and magnetization cannot be accurately controlled, as described above.

Second, in the method disclosed in Published Unexamined Japanese Patent Application No. 54-18235, magnetization is performed by causing magnetization saturation of a magnetic member on two sides of a hysteresis curve using an attenuation alternating field. When the magnetic member is magnetized by an attenuation alternating field, hard magnetization is left in the magnetic member after the alternating field is attenuated. This hard magnetization neutralizes a magnetic field externally applied to the magnetic member so as to reverse the direction of the external magnetic field. As a result, a desired magnetic pole can be formed after the external magnetic field is removed.

In this method, in order to leave a magnetized portion, in the magnetic member, which has a linear relationship with an external magnetic field, an attenuation alternating field which is uniformly changed in strength must be applied to the entire magnetic member. In addition, the initial maximum value of an attenuation alternating field must be set to be larger than the coercive force of the magnetic member. If, therefore, a magnetic member is composed of a magnetic material having a large coercive force, the magnetic member cannot be completely magnetized. That is, a magnetic member having a large coercive force cannot be used in this method.

Third, in the method disclosed in Published Examined Japanese Patent Application No. 63-7420, a magnetic member is heated to a temperature equal to or higher than a temperature corresponding to a magnetic transformation point or to a temperature high enough to eliminate spontaneous magnetization. Thereafter, magnetic fields generated by a multipolar field generator are applied to the magnetic member to form magnetic poles at predetermined positions. The multipolar field generator has a plurality of magnetic pole forming members capable of selectively forming magnetic poles in predetermined directions.

According to this method, since hard magnetization can be left in the magnetic member, magnetic poles having desired strengths required to adjust the static convergence and color purity of a color picture tube can be formed.

Even if poles having desired strengths are formed by this method, since the multipolar field generator having the magnetic pole forming members is arranged during the formation of the magnetic poles, errors may occur in static convergence and color purity when a color picture tube is incorporated in a receiver.

As described, in the above-described methods, a magnetizable annular magnetic member is arranged around an electron gun assembly, and the magnetic member is polarized/magnetized to obtain two, four, six, and twelve poles, thereby adjusting static convergence and color purity. The following three methods are available as methods of polarizing/magnetizing a magnetic member:

(1) A method of generating DC magnetic fields by using magnetizing currents and magnetizing coils on the basis of information from an adjusting unit.

(2) A method using an attenuation alternating field to cause magnetization saturation of a magnetic member on two sides of a hysteresis curve.

(3) A method of heating a magnetic member to a temperature equal to or higher than a temperature corresponding to a magnetic transformation point or to a temperature high enough to eliminate spontaneous magnetization, and subsequently applying magnetic fields to the magnetic member to form magnetic poles at predetermined positions.

The method (3) of heating a magnetic member to a temperature equal to or higher than a temperature corresponding to a magnetic transformation point or to a temperature high enough to eliminate spontaneous magnetization, and applying magnetic fields to the magnetic member is effective in forming desired magnetic poles as well as the method (2). However, when a color picture tube is incorporated in a receiver, errors occur in static convergence and color purity. Such errors do not occur in the step of forming magnetic poles in a magnetic member by means of the multipolar field generator but occur when the generator is detached after desired magnetic poles are formed. It is found from an examination on the cause of these errors that the magnetic pole forming members of the multipolar field generator which are composed of a ferromagnetic material change the distribution of geomagnetism. For this reason, even if static convergence and color purity are accurately adjusted by using the multipolar field generator, once it is detached, the distribution of geomagnetism with respect to the color cathode ray tube apparatus is changed to cause errors.

A magnetic shield consisting of a magnetic material is arranged inside or outside a color cathode ray tube apparatus to minimize the influences of geomagnetism. Even with the magnetic shield, however, the influence of geomagnetism cannot be completely eliminated.

Under the circumstances, color cathode ray tube apparatuses are classified into types used in, e.g., the Northern hemisphere, in the Southern hemisphere, and in the equatorial area in accordance with the distribution state of geomagnetism. With this classification, color cathode ray tube apparatuses are adjusted to obtain good images in the respective areas.

Generally, a large number of nonmagnetic members are used for manufacturing equipment of a color cathode ray tube apparatus, especially test devices for such equipment. If a magnetic material is used, it is used in a manner not to disturb geomagnetism. In addition, a uniform magnetic field is applied to the entire color cathode ray tube apparatus, as needed, to prevent unexpected influences. However, when a magnetic member is arranged on a color cathode ray tube, and magnetic poles are formed in the magnetic member by generating magnetic fields from the outside of the color cathode ray tube apparatus, the magnetic pole forming members of the multipolar field generator must be arranged close to the magnetic member. In addition, in order to leave hard magnetization in the magnetic member, each magnetic pole forming member needs to have a core consisting of a ferromagnetic material capable of generating a magnetic field. Therefore, it is difficult to remove all magnetic materials from positions near the color cathode ray tube apparatus. That is, the geomagnetism cannot be completely free from the influences of the magnetic pole forming members.

A magnet for adjusting static convergence and color purity is arranged near a deflection yoke. When magnetic poles are formed in a magnetic member, the multipolar field generator is placed near the deflection yoke. For this reason, a magnetic field generated by the deflection yoke influences the electron gun assembly. More specifically, when the multipolar field generator is placed near the electron gun assembly, the external field distribution of the deflection yoke is changed. This is because the field is changed by a magnetizing yoke, of the multipolar field generator, consisting of a ferromagnetic material. Therefore, if the multipolar field generator is arranged at the neck, static convergence and color purity are changed. Alternatively, an induction current is generated in coils constituting the multipolar field generator due to a high-frequency field generated by the deflection yoke, thus generating a magnetic field. This magnetic field also causes a change in static convergence and color purity.

The change in static convergence and color purity which is based on the above-mentioned reason is small. For example, a static convergence change amount of a 25" 110° deflection tube is about 0.1 mm. Such a small change amount normally falls within the error range of static convergence measurement. Therefore, no practical problems are posed except for cases wherein especially static convergence is of prime importance, or the rating margins are very small. However, such a change amount cannot be allowed in a display tube of the present invention, in which almost no variation in static convergence is allowed, and even a change amount of 0.1 mm or less poses a problem.

SUMMARY OF THE INVENTION

The present invention has been made to solve the problem described above and to prevent a change in distribution of geomagnetism and external magnetic field around a color cathode ray tube even if a field generator is arranged to form magnetic poles in a magnetic member placed at a predetermined position inside or outside the tube.

According to the present invention, there is provided a method of manufacturing a color cathode ray tube apparatus including: a vacuum envelope comprising a panel section, a funnel section, and a neck section, the panel section having an axis and a face plate, a front view shape of which is substantially rectangular and which has an inner surface and having a skirt extending from a peripheral edge of the face plate, the neck section being formed in a substantially cylindrical shape, the funnel section being continuous to the neck section, a phosphor screen formed on the inner surface of the face plate, a shadow mask arranged in the panel section to oppose the phosphor screen on the face plate, an electron gun assembly, housed in the neck section, for emitting three electron beams, a deflection unit for vertically and horizontally deflecting the electron beams emitted from the electron gun assembly, and at least one magnetic member arranged inside or outside the neck section around the electron gun assembly, the method comprising the sequential steps of: arranging the at least one magnetic member at a predetermined position around the electron gun assembly, measuring characteristic data of static convergence and/or color purity of the color cathode ray tube apparatus, arranging a multipolar field generator around the neck section, the multipolar field generator serving as a magnetization unit for generating a magnetic field to magnetize the at least one magnetic member, changing a magnetizing force of the multipolar field generator in accordance with correction data based on a combination of the characteristic data of static convergence and/or color purity and data of an external magnetic field, magnetizing the at least one magnetic member by the magnetizing force from the magnetization unit, and detaching the multipolar field generator as the magnetization unit from the neck section.

In addition, there is provided a method of manufacturing a color cathode ray tube apparatus, comprising the sequential steps of arranging the at least one magnetic member at a predetermined position around the electron gun assembly, measuring characteristic data of static convergence and/or color purity of the color cathode ray tube apparatus, arranging a multipolar field generator around the neck section, the multipolar field generator serving as a magnetization unit for generating a magnetic field to magnetize the at least one magnetic member and having a plurality each of main and auxiliary portions, supplying a current to the main portions of the multipolar field generator in accordance with the characteristic data of static convergence and/or color purity, simultaneously supplying a current to the auxiliary portions of the multipolar field generator in accordance with data of an external magnetic field simultaneously as the step of supplying a current to the main portions of the multipolar field generator, magnetizing the at least one magnetic member by a magnetizing force from the magnetization unit, and detaching the multipolar field generator as the magnetization unit from the neck section.

According to the method of manufacturing a color cathode ray tube apparatus, the multipolar field generator is arranged to generate a magnetic field for canceling the influences on an external field. Since the multipolar field generator can form the same distribution of geomagnetism as that obtained when the generator is not arranged, the static convergence and the color purity can be adjusted with high precision.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Embodiments of the present invention will be described below with reference to the accompanying drawings.

Figure 3:
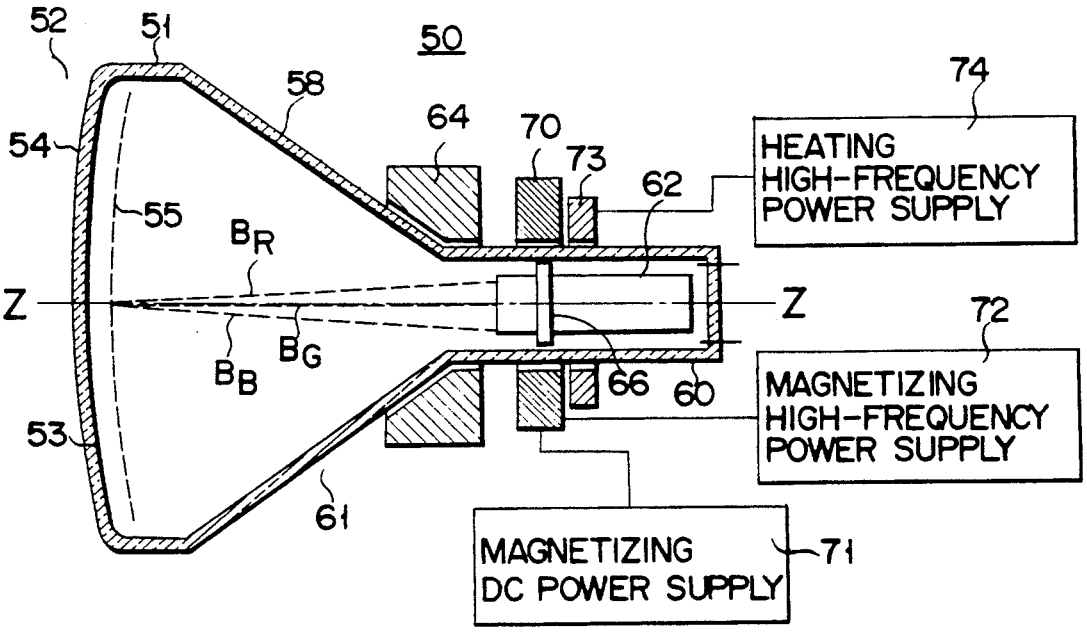
FIG. 3 is a sectional view of a color cathode ray tube according to the first embodiment of the present invention.

FIG. 3 shows a color cathode ray tube apparatus according to the first embodiment of the present invention. A color cathode ray tube apparatus 50 comprises an envelope 61 including a panel section 52 having a substantially rectangular face plate 54 and a skirt 51 extending from a peripheral edge of the face plate 54, a funnel section 58 joined to the panel section 52, and a neck section 60 continuous with the funnel section 58. A vacuum state in the cathode ray tube is held by the panel section 52, the funnel section 58, and the neck section 60. A phosphor screen 53 consisting of three light-emitting layers for emitting three colors, i.e., red, green, and blue, is formed on the inner surface of the face plate 54 of the panel section 52. A shadow mask 55 is arranged to oppose the phosphor screen 53. An electron gun assembly 62 for emitting three electron beams $B_R$, $B_G$, and $B_B$ is housed in the neck section 60. A deflection unit 64 is arranged on the outer surfaces of the funnel section 58 and the neck section 60. The deflection unit 60 has horizontal and vertical deflection coils for respectively generating magnetic fields to horizontally and vertically deflect the electron beams $B_R$, $B_G$, and $B_B$ . In addition, one or more magnetizable magnetic members 66 are arranged at a predetermined position around the electron gu assembly 62 in the neck section 60.

A multipolar field generator 70 as a magnetization unit for magnetizing the magnetic member 66 is arranged around the neck section 60. This multipolar field generator 70 serves to form multiple magnetic poles, e.g., two, four, and six magnetic poles, and a combination thereof. A magnetizing DC power supply 71 is connected to the multipolar field generator 70. In addition, a magnetizing high-frequency power supply 72 is connected to the generator 70 as needed. A high-frequency heating coil 73 is arranged near or integrated with the multipolar field generator 70. The high-frequency heating coil 73 heats the magnetic member 66 or controls its temperature. A heating high-frequency power supply 74 for supplying a high-frequency current is connected to the high-frequency heating coil 73.

Figure 4:
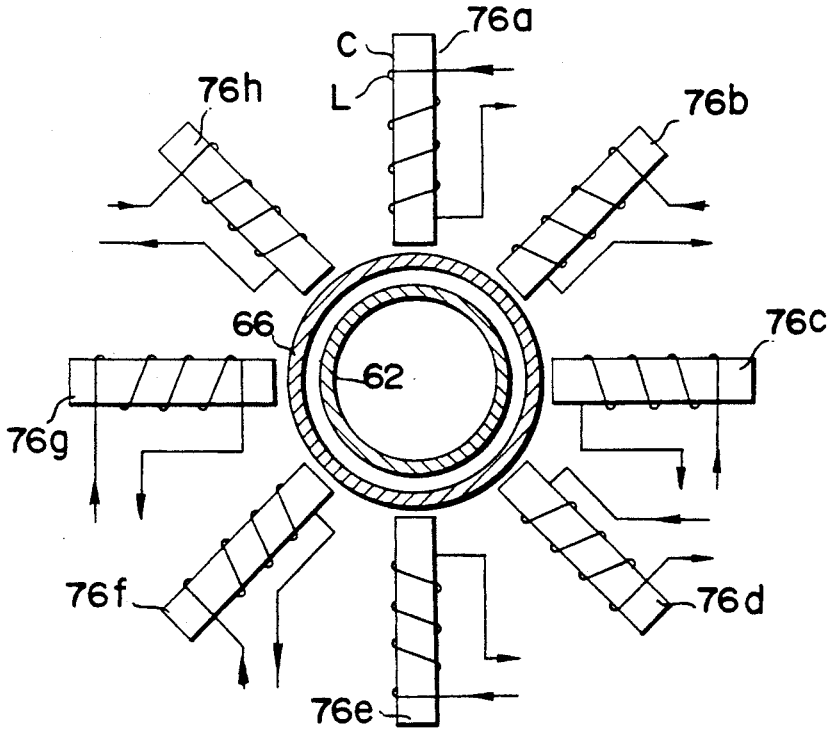
FIG. 4 is a schematic sectional view of the color cathode ray tube apparatus including a multipolar field generator according to the first embodiment.

FIG. 4 shows the above-described multipolar field generator 70. The multipolar field generator 70 has a plurality of magnetic pole forming members, eight members 76*a* to 76*h* in this case. Each of the magnetic pole forming members 76*a* to 76*h* is constituted by a solid columnar core composed of a ferromagnetic material such as a soft steel, a permalloy, or a $\mu$-metal, and a coil L wound around the core. These magnetic pole forming members 76*a* to 76*h* are arranged around the neck section 60 at equal angular intervals and at the same distance from the magnetic member 66 in such a manner that the longitudinal direction of each core coincides with the radial direction of the magnetic member 66. Each of the magnetic pole forming members 76*a* to 76*h* used for a normal color cathode ray tube apparatus having a neck outer diameter of 22.5 to 36.1 mm is designed such that a coated copper wire having a diameter of about 0.5 mm is wound around a core having a diameter of 10 mm and a length of 50 mm by 50 to 100 turns.

A method of magnetizing the magnetic member by using the above-mentioned magnetization unit will be described below.

An assembled color cathode ray tube apparatus is operated to set a state wherein three electron beams land on the phosphor screen 53. A predetermined high-frequency current is supplied to the high-frequency heating coil 73 to heat the magnetic member 66. If, in this case, the magnetic member is composed of a precipitation hardening material for precipitating spinodal or bicalloy, the member is heated to a temperature equal to or lower than a temperature corresponding to a magnetic transformation point. If the magnetic member is composed of strontium ferrite or the like, the member is heated to a temperature Tt at which spontaneous magnetization disappears. When the magnetic member is heated to such a temperature, the coercive force is reduced, and the member becomes more susceptible to magnetization. Therefore, a magnetic field to be externally applied to the magnetic member to magnetize it can be set to be smaller than a magnetic field at a normal temperature.

Subsequently, a static field is generated by supplying a current of $-5$ to $+5$ A from the magnetizing DC power supply 71 to two or more magnetic pole forming members selected from the eight magnetic pole forming members 76*a* to 76*h* of the multipolar field generator 70 on the basis of characteristic data of at least one of static convergence and color purity, of the color cathode ray tube apparatus, which is obtained in advance by measurement. The magnetic member 66 heated to the temperature Tt is magnetized by this static field. In this case, the magnitude of a current to be supplied to the selected magnetic pole forming members is determined in consideration of currents to be supplied to specific magnetic pole forming members so as to correct the influences, of the multipolar field generator, on the geomagnetism (to be described later).

Figure 5A:
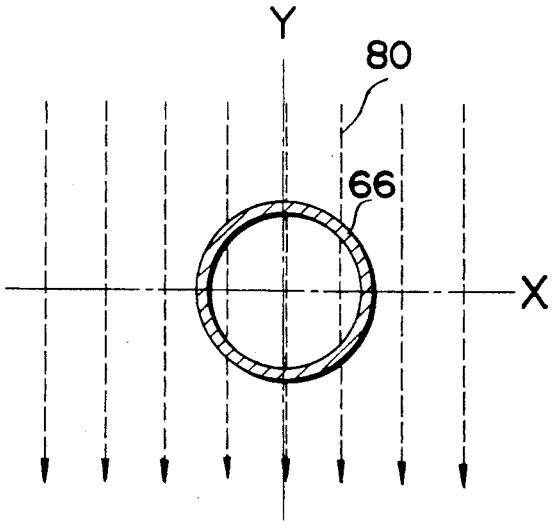
FIG. 5A is a view showing the distribution of geomagnetism around the color cathode ray tube apparatus without the multipolar field generator.
Figure 5B:
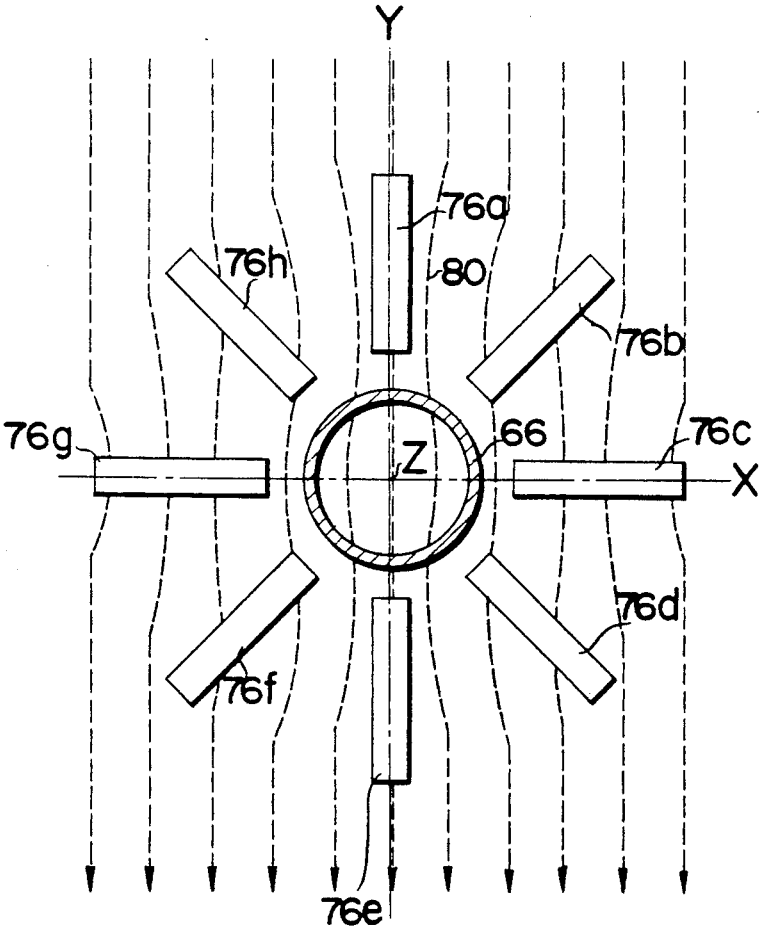
FIG. 5B is a view showing the distribution of geomagnetism around the color cathode ray tube apparatus with the multipolar field generator.

As shown in FIG. 5A, the magnetic member 66 arranged in the neck section of the calor cathode ray tube apparatus is relatively small in size. For this reason, if the magnetic member 66 is composed of a hard magnetic material such as bicalloy, kunico, or kunife, and if no magnetic pole forming members are arranged around the color cathode ray tube apparatus, the distribution of lines 80 of magnetic force of geomagnetism is substantially uniform. Especially in the Northern hemisphere, the lines of magnetic force are almost uniformly distributed in the vertical direction. If, however, the magnetic pole forming members 76*a* to 76*h* are arranged around the magnetic member 66, since lines 80 of magnetic force pass through regions where the magnetic resistance is small, the lines 80 of magnetic force are concentrated in certain regions, as shown in FIG. 5B. The regions where the lines of magnetic force are concentrated are located around the magnetic pole forming members 76*a* and 76*e* whose longitudinal direction coincides with the direction of the lines of magnetic force. As a result, the distribution of geomagnetism around the color cathode ray tube apparatus is changed. If, therefore, the static convergence and color purity of the color cathode ray tube apparatus are adjusted in this state wherein the distribution of geomagnetism is changed, static convergence and color purity errors occur in the normal use of the color cathode ray tube apparatus in which the magnetic pole forming members 76*a* to 76*h* are not arranged around the magnetic member 66. That is, if the static convergence and color purity of the color cathode ray tube apparatus are adjusted in a state wherein the magnetic pole forming members 76*a* to 76*h* are arranged around the magnetic member 66, errors occur after the adjustment because the distribution of geomagnetism with the magnetic pole forming members 76*a* to 76*h* is different from that without the members 76*a* to 76*h*.

Figure 6A:
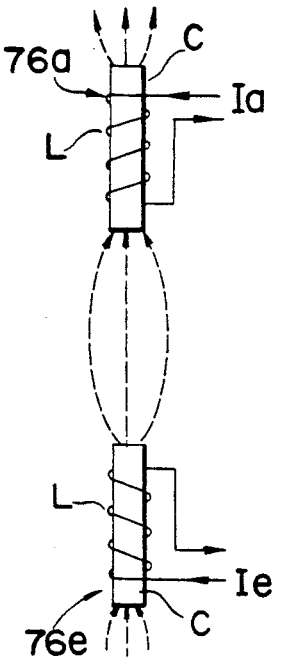
FIG. 6A is a view showing a magnetic field which is generated by a magnetic pole forming member to eliminate the influences of a magnetic field from the multipolar field generator.
Figure 6B:
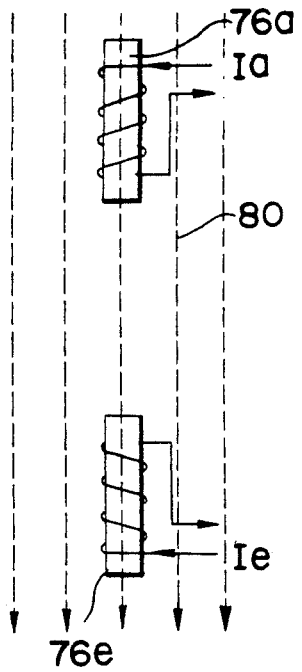
FIG. 6B is a view showing the distribution of geomagnetism influenced by a magnetic field generated by the multipolar field generator in FIG. 6A.

When magnetic poles are to be formed in the magnetic member 66 by using the multipolar field generator 70, currents Ia and Ie are supplied to the magnetic pole forming members 76*a* and 76*e* to generate a magnetic field in a direction to cancel the lines 80 of magnetic force of geomagnetism shown in FIG. 6A. In Japan, since the geomagnetism is about 0.3 gauss, each of the currents Ia and Ie may be set to be as small as about 10 mA. When the above currents are supplied to the magnetic pole forming members 76*a* and 76*e* to generate a magnetic field, the field distribution becomes the same as that obtained when no magnetic pole forming members are present, as shown in FIG. 6B. That is, the lines 80 of magnetic force around the color cathode ray tube apparatus are controlled to have the distribution shown in FIG. 5A.

Characteristic data is obtained by correcting the influences, of the multipolar field generator 70, on the geomagnetism, and measuring the static convergence and color purity of the color cathode ray tube apparatus. When the magnetic member 66 is magnetized on the basis of the characteristic data, even if the multipolar field generator 70 is arranged to generate magnetic fields, the static convergence and the color purity can be adjusted in the same field distribution as that of geomagnetism in the normal use of the color cathode ray tube apparatus. As a result, the static convergence and color purity of the color cathode ray tube apparatus can be adjusted to eliminate errors in the same state as a normal operation state of the apparatus.

A case will be described below, in which magnetic poles are formed in the magnetic member 66 by supplying currents to the coils L of the magnetic pole forming members 76*a* and 76*e*. Assume that the currents Ia and Ie to be supplied to the coils L of the magnetic pole forming members 76a and 76e are set as Ia=+0.01 A and Ie=−0.01 A in order to correct the influences, of the multipolar field generator 70, on the geomagnetism, and that the currents Ia and Ie to be supplied to the coils L of the magnetic pole forming members 76a and 76e are set to be +2 A and −2 A, respectively, so as to adjust the static convergence and the color purity without correcting the influences, of the multipolar field generator 70, on the geomagnetism. In this case, desired magnetic poles can be formed by respectively supplying currents of $(+2+\alpha\times0.01)$ A and $(-2+\alpha\times0.01)$ A to the magnetic pole forming members 76a and 76e. Note that $\alpha$ is a coefficient to be empirically determined.

Figure 7:
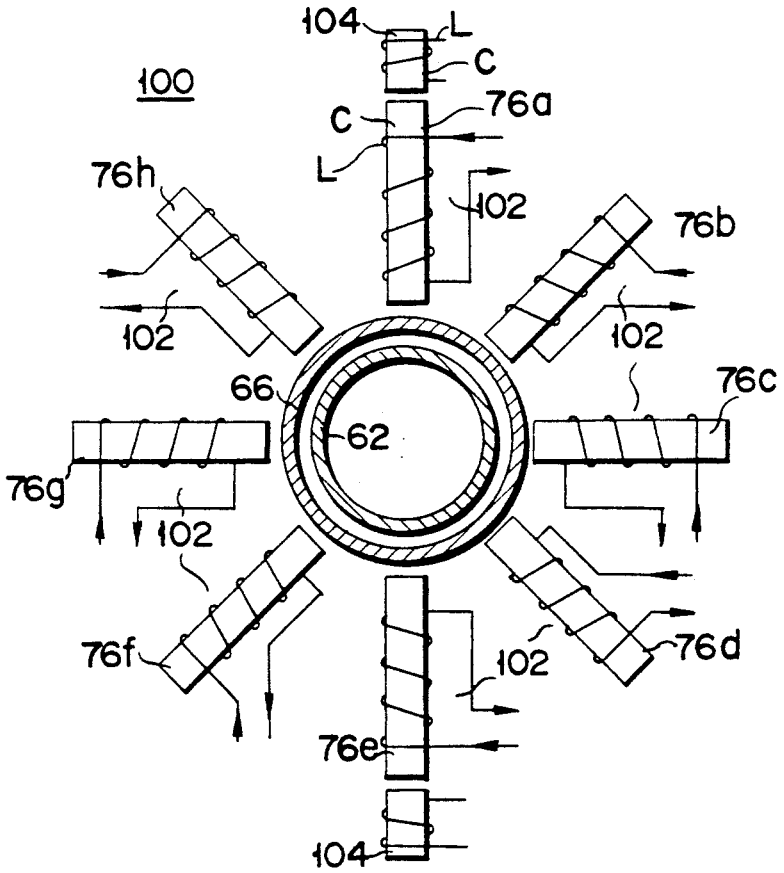
FIG. 7 is a schematic sectional view of a color cathode ray tube apparatus including a multipolar field generator according to the second embodiment of the present invention.

FIG. 7 shows a method of manufacturing a color cathode ray tube apparatus according to the second embodiment of the present invention. Since the structure of the second embodiment is the same as that of the first embodiment except for a multipolar field generator, a description of the same members will be omitted.

A multipolar field generator 100 as a magnetization unit for magnetizing a magnetic member 66 is arranged around a neck section 60. This multipolar field generator 100 serves to form multiple magnetic poles, e.g., two, four, and six magnetic poles, and a combination thereof. A magnetizing DC power supply (not shown) is connected to the multipolar field generator 100. In addition, a magnetizing high- C frequency power supply (not shown) is arranged as needed. A high-frequency heating coil (not shown) is arranged near or integrated with the multipolar field generator 70. The high-frequency heating coil heats the magnetic member 66 or controls its temperature. A heating high-frequency power supply (not shown) for supplying a high-frequency current is connected to the high-frequency heating coil.

The multipolar field generator 100 has a plurality of magnetic pole forming members, eight members 76a to 76h in this case. The magnetic pole forming members 76a to 76h respectively have main coils 102, whereas only the members 76a and 76e additionally have auxiliary coils 104. Each of these magnetic pole forming members 76a to 76h is constituted by a solid columnar core C composed of a ferromagnetic material such as soft steel, a permalloy, or a $\mu$-metal, and a coil L wound around the core. The main coils 102 of the magnetic pole forming members 76a to 76h are arranged around the neck section 60 at equal angular intervals and at the same distance from the magnetic member 66 in such a manner that the longitudinal direction of each core coincides with the radial direction of the magnetic member 66. The main coil 102 of each of the magnetic pole forming members 76a to 76h used for a normal color cathode ray tube apparatus having a neck outer diameter of 22.5 to 36.1 mm is designed such that a coated copper wire having a diameter of about 0.5 mm is wound around a core having a diameter of 10 mm and a length of 70 mm by 100 to 800 turns. In addition, the auxiliary coils 104 of the magnetic pole forming members 76a and 76e are arranged such that their longitudinal direction coincides with the radial direction of the magnetic member 66.

A method of magnetizing the magnetic member by using the above-mentioned magnetization unit according to the second embodiment will be described below.

An assembled color cathode ray tube apparatus is operated to set a state wherein three electron beams land on the phosphor screen 53. A predetermined high-frequency current is supplied to the high-frequency heating coil to heat the magnetic member 66. If, in this case, the magnetic member is composed of a precipitation hardening material for precipitating spinodal or bicalloy, the member is heated to a temperature equal to or lower than a temperature corresponding to a magnetic transformation point. If the magnetic member is composed of a strontium ferrite or the like, the member is heated to a temperature Tt at which spontaneous magnetization disappears. When the magnetic member is heated to such a temperature, the coercive force is reduced, and the member becomes more susceptible to magnetization. Therefore, a magnetic field to be externally applied to the magnetic member to magnetize it can be set to be smaller than a magnetic field at a normal temperature.

Subsequently, a static field is generated by supplying a current of −5 to +5 A from the magnetizing DC power supply 71 to two or more main coils selected from the main coils 102 of the eight magnetic pole forming members 76a to 76h of the multipolar field generator 100 on the basis of characteristic data of at least one of static convergence and color purity, of the color cathode ray tube apparatus, which is obtained in advance by measurement. The magnetic member 66 heated to the temperature Tt is magnetized by this static field. In this case, the magnitude of a current to be supplied to the selected magnetic pole forming members is determined in consideration of currents to be supplied to specific magnetic pole forming members so as to correct the influences, of the multipolar field generator, on the geomagnetism (to be described later).

The magnetic member 66 arranged in the neck section of the calor cathode ray tube apparatus is relatively small in size. For this reason, if the magnetic member 66 is composed of a hard magnetic material such as bicalloy, kunico, or kunife, and if no magnetic pole forming members are arranged around the color cathode ray tube apparatus, the distribution of lines of magnetic force of geomagnetism is substantially uniform. Especially in the Northern hemisphere, the lines of magnetic force are almost uniformly distributed in the vertical direction. If, however, the magnetic pole forming members 76a to 76h are arranged around the magnetic member 66, since lines of magnetic force pass through regions where the magnetic resistance is small, the lines of magnetic force are concentrated in certain regions. The regions where the lines of magnetic force are concentrated are located around the magnetic pole forming members 76a and 76e whose longitudinal direction coincides with the direction of the lines of magnetic force. As a result, the distribution of geomagnetism around the color cathode ray tube apparatus is changed. If, therefore, the static convergence and color purity of the color cathode ray tube apparatus are adjusted in this state wherein the distribution of geomagnetism is changed, static convergence and color purity errors occur in the normal use of the color cathode ray tube apparatus in which the magnetic pole forming members 76a to 76h are not arranged around the magnetic member 66. That is, if the static convergence and color purity of the color cathode ray tube apparatus are adjusted in a state wherein the magnetic pole forming members 76a to 76h are arranged around the magnetic member 66, errors occur after the adjustment because the distribution of geomagnetism with the magnetic pole forming members 76a to 76h is different from that without the members 76a to 76h.

When magnetic poles are to be formed in the magnetic member 66 by using the multipolar field generator 100, currents Ia and Ie are supplied to the auxiliary coils 104 of the magnetic pole forming members 76*a* and 76*e* to restore the lines of magnetic force of geomagnetism, which are changed when the multipolar field generator 100 is arranged, to the original state. When the above currents are supplied to the magnetic pole forming members 76*a* and 76*e* to generate a magnetic field, the field distribution becomes the same as that obtained when no magnetic pole forming members are present.

In the above two embodiments, the core of each magnetic pole forming member has a columnar shape with a circular cross-section. However, the present invention is not limited to this. For example, each core may be formed to have a rectangular cross-section.

In the above two embodiments, each core has a columnar shape with a uniform diameter. However, in order to concentrate a magnetic field, generated by a corresponding magnetic pole forming member, on a small region of the magnetic member arranged in the neck section of the color cathode ray tube apparatus, each core may be tapered narrower toward the magnetic member side. With this arrangement, since a magnetic field generated by each magnetic pole forming member is concentrated on a small region, the static convergence and the color purity can be properly adjusted.

Figure 1:
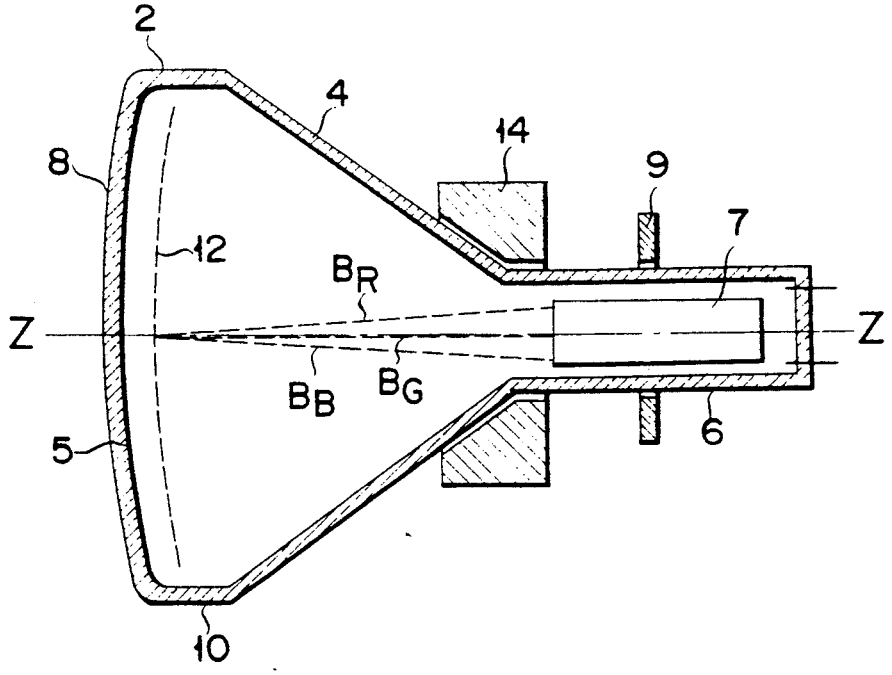
FIG. 1 is a sectional view of a conventional color cathode ray tube apparatus.
Figure 2:
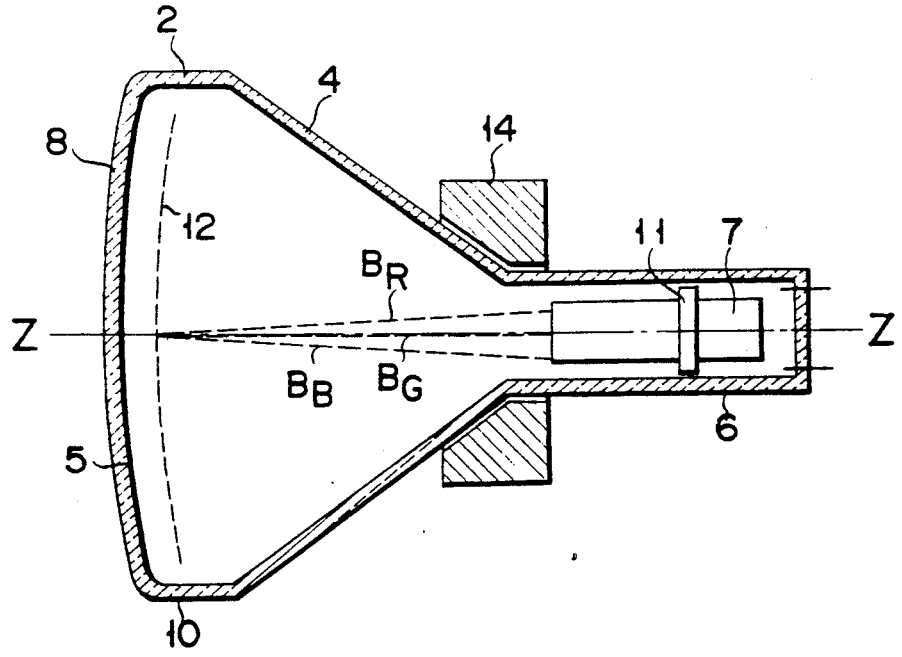
FIG. 2 is a sectional view of another conventional color cathode ray tube apparatus.

In the above embodiments, the magnetic member is magnetized after it is heated. However, the present invention is not limited to this method. For example, the following methods may be used: a method using a rotating demagnetization field or demagnetizing a magnetized magnetic member; and a method of magnetizing a magnetic member by generating a pulsed magnetic field using the magnetizing high-frequency power supply of the magnetization unit shown in FIG. 1.

The magnetic member of the present invention is arranged around the electron gun assembly in the neck section. However, the present invention is not limited to this. The magnetic member may be arranged outside the neck section.

In the above embodiments, changes in convergence and color purity are corrected by using the coils of the multipolar field generator. However, such correction may be performed by arranging other coils or magnets.

According to the present invention, a magnetic member is arranged at a predetermined position around the electron gun assembly of a color cathode ray tube apparatus, and a multipolar field generator having magnetic pole forming members is arranged in correspondence with the magnetic member. The magnetic member is magnetized by the multipolar field generator to set proper static convergence and color purity. When the multipolar field generator is arranged around the neck, the state of geomagnetism around the neck is changed. However, since magnetic fields are generated by the multipolar field generator in consideration of a state wherein the color cathode ray tube apparatus is used without arranging the multipolar field generator around the neck, proper correction can be performed.

Additional advantages and modifications will readily occur to those skilled in the art. Therefore, the invention in its broader aspects is not limited to the specific details, and illustrated examples shown and described herein. Accordingly, various modifications may be made without departing from the spirit or scope of the general inventive concept as defined by the appended claims and their equivalents.

What is claimed is:

1. A method of manufacturing a color cathode ray tube apparatus including:

a vacuum envelope comprising a panel section, a funnel section, and a neck section, the panel section having an axis and a face plate, a front view shape of which is substantially rectangular and which has an inner surface and having a skirt extending from a peripheral edge of said face plate, the neck section being formed in a substantially cylindrical shape, the funnel section being continuous to said neck section;

a phosphor screen formed on said inner surface of said face plate;

a shadow mask arranged in said panel section to oppose said phosphor screen on said face plate;

an electron gun assembly, housed in said neck section, for emitting three electron beams;

a deflection unit for vertically and horizontally deflecting the electron beams emitted from said electron gun assembly; and at least one magnetic member arranged inside or outside said neck section around said electron gun assembly, the method comprising the sequential steps of:

arranging said at least one magnetic member at a predetermined position around said electron gun assembly;

measuring characteristic data of at least one of static convergence and color purity of said color cathode ray tube apparatus;

arranging a multipolar field generator around said neck section, said multipolar field generator serving as a magnetization unit for generating a magnetic field of magnetize said at least one magnetic member;

changing a magnetizing force of said multipolar field generator in accordance with correction data based on a combination of the characteristic data of at least one of static convergence, color purity, and an external magnetic field, and data for correcting a disorder of the external magnetic field caused by the arrangement of said multipolar field generator;

magnetizing said at least one magnetic member by the magnetizing force from said magnetization unit; and detaching said multipolar field generator as the magnetization unit from said neck section.

2. A method according to claim 1, wherein said at least one magnetic member is formed into a ring-like shape.

3. A method according to claim 1, wherein said at least one magnetic member consists of a precipitation hardening material for precipitating spinodal or bicalloy, or of strontium ferrite.

4. A method according to claim 1, wherein the step of arranging said multipolar field generator around said neck section includes the step of arranging a high-frequency heating coil near said multipolar field generator.

5. A method according to claim 1, wherein a magnetizing DC power supply is connected to said multipolar field generator, and a magnetizing high-frequency power supply is connected to said multipolar field generator as needed.

6. A method according to claim 1, wherein said multipolar field generator includes a plurality of magnetic pole forming members arranged around said neck section.

7. A method according to claim 6, wherein each of said plurality of magnetic pole forming members of said multipolar field generator includes a core composed of a ferromagnetic material selected from the group consisting of soft steel, a permalloy, and a μ-metal, and a coil consisting of a coated copper wire.

8. A method according to claim 7, wherein said core of each of said plurality of magnetic pole forming members is formed into a solid column having a diameter of about 10 mm and a length of about 70 mm, and said coil has a diameter of about 0.5 mm and is wound around said core by 100 to 800 turns.

9. A method of manufacturing a color cathode ray tube apparatus including:

a vacuum envelope comprising a panel section, a funnel section, and a neck section, the panel section having an axis and a face plate, a front view shape of which is substantially rectangular and which has an inner surface and having a skirt extending from a peripheral edge of said face plate, the neck section being formed in a substantially cylindrical shape, the funnel section being continuous to said neck section;

a phosphor screen formed on said inner surface of said face plate;

a shadow mask arranged in said panel section to oppose said phosphor screen on said face plate;

an electron gun assembly, housed in said neck section, for emitting three electron beams;

a deflection unit for vertically and horizontally deflecting the electron beams emitted from said electron gun assembly; and at least one magnetic member arranged inside or outside said neck section around said electron gun assembly, the method comprising the sequential steps of:

arranging said at least one magnetic member at a predetermined position around said electron gun assembly;

measuring characteristic data of at least one of static convergence, and color purity of said color cathode ray tube apparatus;

arranging a multipolar field generator around said neck section, said multipolar field generator serving as a magnetization unit for generating a magnetic field to magnetize said at least one magnetic member and having a plurality each of main and auxiliary portions;

supplying a current to said main portions of said multipolar field generator in accordance with the characteristic data of at least one of static convergence, and color purity;

supplying a current to said auxiliary portions of said multipolar field generator in accordance with data of an external magnetic field simultaneously as the step of supplying a current to said main portions of said multipolar field generator magnetizing said at least one magnetic member by a magnetizing force from said magnetization unit; and detaching said multipolar field generator as the magnetization unit from said neck section.

10. A method according to claim 9, wherein said at least one magnetic member is arranged in contact with an outer surface of said electron gun assembly in said neck section.

11. A method according to claim 9, wherein said at least one magnetic member is formed into a ring-like shape.

12. A method according to claim 9, wherein said at least one magnetic member consists of a precipitation hardening material for precipitation spinodal or bicalloy, or of strontium ferrite.

13. A method according to claim 9, wherein the step of arranging said multipolar field generator around said neck section includes the step of arranging a high-frequency heating coil near said multipolar field generator.

14. A method according to claim 9, wherein a magnetizing DC power supply is connected to said multipolar field generator, and a magnetizing high-frequency power supply is connected to said multipolar field generator as needed.

15. A method according to claim 9, wherein said multipolar field generator comprises a plurality of magnetic pole forming members having both said main and auxiliary portions, and a plurality of magnetic pole forming members having only said main portions.

16. A method according to claim 15, wherein each of said plurality of magnetic pole forming members of said multipolar field generator includes a core composed of a ferromagnetic material selected from the group consisting of soft steel, a permalloy, and a μ-metal, and a coil consisting of a coated copper wire.

17. A method according to claim 16, wherein said core of each of said plurality of magnetic pole forming members is formed into a solid column having a diameter of about 10 mm and a length of about 70 mm, and said coil has a diameter of about 0.5 mm and is wound around said core by 100 to 800 turns.

* * * * *